United States Patent [19]

Ohinata

[11] Patent Number: 4,906,003

[45] Date of Patent: Mar. 6, 1990

[54] SQUASH BALL GAME MACHINE

[75] Inventor: Mikio Ohinata, Tokyo, Japan

[73] Assignee: Zuck Co., Ltd., Tokyo, Japan

[21] Appl. No.: 337,515

[22] Filed: Apr. 13, 1989

Related U.S. Application Data

[63] Continuation-in-part of Ser. No. 93,819, Sep. 8, 1987, abandoned.

[51] Int. Cl.[4] ..... A63F 7/20

[52] U.S. Cl. ..... 273/85 R; 273/85 C

[58] Field of Search ..... 273/85 R, 85 C, 85 D

[56] References Cited

U.S. PATENT DOCUMENTS 1,310,482 7/1919 Iles ..... 273/85 C 3,931,972 1/1976 Fabian ..... 273/85 R 4,313,605 2/1982 Stokes et al. ..... 273/85 C 4,334,682 6/1982 Ham ..... 273/85 C

*Primary Examiner*—Anton O. Oechsle

*Attorney, Agent, or Firm*—Moonray Kojima

[57] ABSTRACT

A squash ball game machine in which the racket board is tilted (forward and backward) and rocked (sideways) in a direction and angle which the player desires through operation conducted by the player, to catch a falling ball thereon, whereupon the hitting block located at the point whereat the ball hits is pushed upward instantaneously from the racket board, whereby the ball is hit and moved to strike against a play field plate with the ball then again falling, and then the procedure is repeated in the manner of a squash ball game.

4 Claims, 4 Drawing Sheets

SQUASH BALL GAME MACHINE

This is a continuation-in-part of Ser. No. 93,819 filed 9/8/87, now abandoned.

BACKGROUND OF THE INVENTION

1. Field of Invention

This invention relates to a squash ball game machine such as placed in amusement parks, play grounds, etc.

2. Description of the Prior Art

In the art, there are different types of game machines, such as pinball, bingo, sports machines, etc. These machines are in wide use to provide entertainment. One such game machine is one adapted to play squash ball, wherein a player enters a box space, hits a ball with a racket against one of six field plates, and then repeatedly hits back the ball which rebounds directly or after striking the play field plate.

SUMMARY OF THE INVENTION

An object of the invention is to provide a game machine which utilizes the rules of squash ball.

Another object is to provide a more attractive and amusing game machine.

According to the invention, a racket board is tilted (i.e. forward and backward) and rocked (i.e. sideways) in desired directions and angles to catch a falling ball, whereupon a hitting block at the point at which the ball falls is moved upward from the racket board to hit the ball, and then repeat the operation when the ball falls back down after hitting a field plate.

DETAILED DESCRIPTION OF PREFERRED EMBODIMENTS

Figure 1:
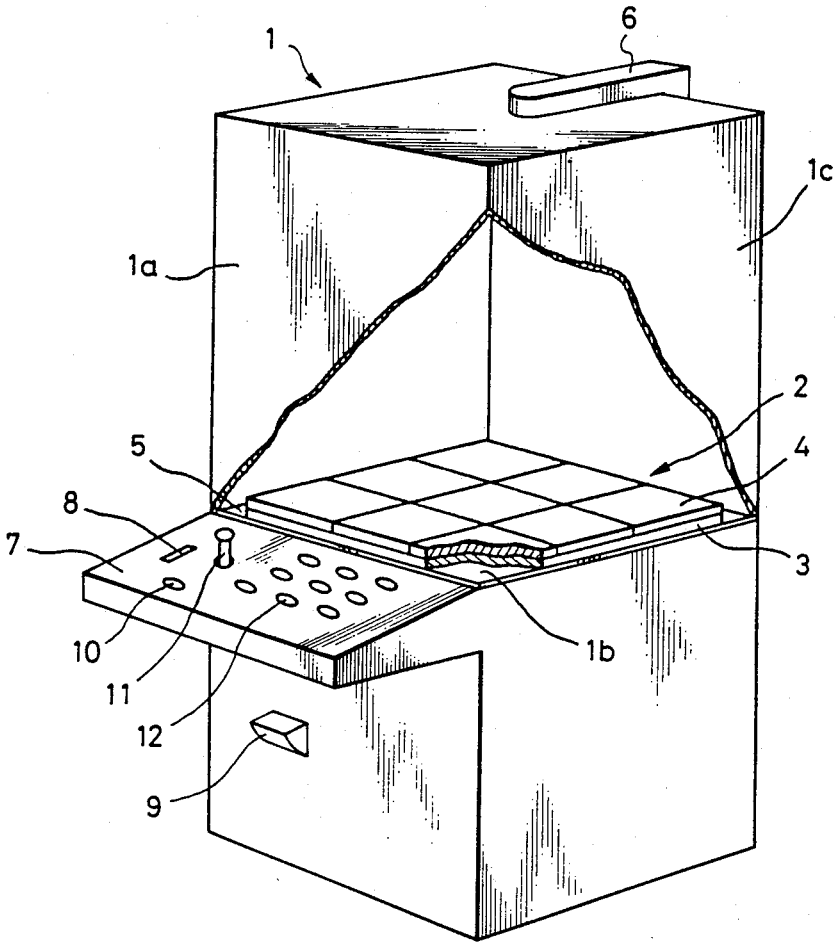
FIG. 1 is a partially cut away perspective view depicting an illustrative embodiment of the invention.

Referring to FIG. 1 a front face 1*a* of play field box 1 (called "box") is formed of a transparent plate, such as of glass or plastic, and a racket board 2 is disposed toward the inside bottom of box 1. The remaining faces each constitute a play field plate 1*c*.

Racket board 2 comprises a racket base 3 and one or more hitting blocks 4 disposed thereon. In FIG. 1, there are depicted 9 hitting blocks 4; but, other numbers of blocks can be used. The mechanism for moving the blocks is shown in greater detail in FIG. 2. Between racket board 2 and the side wall of box 1 is formed slots 5 which are used to recover fallen balls. Outside of box 1 is provided a transfer device 6 for transferring and storing lost balls which may have fallen into slots 5, to an upper part of box 1 using known means, such as, for example, a mechanical chain elevator or compressed air mechanism, or the like.

An operating panel 7 is provided in front of face 1*a*. On panel 7 there are provided a metal inlet port 8, a metal discharge port 9 (for accepting and ejecting slugs, tokens, or the like), a game start button 10, an operating handle 11 for the racket board 2, and nine operating buttons 12, one for each hitting block 4.

Figure 2:
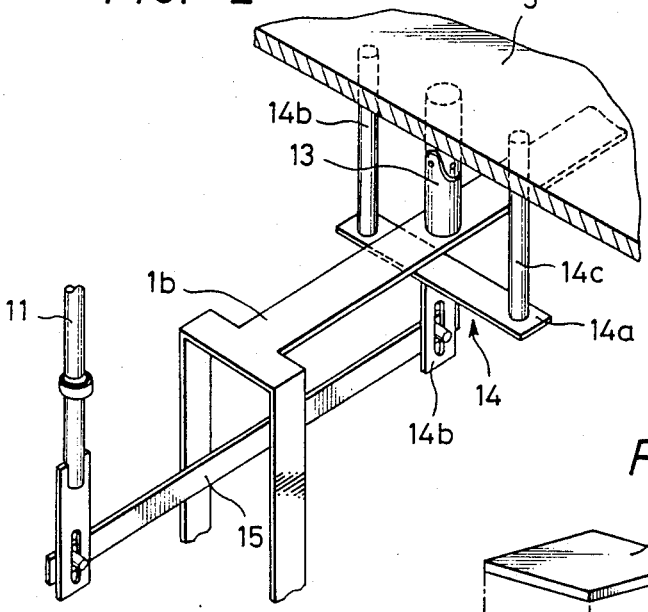
FIG. 2 is a partially cut away perspective view depicting a racket board operating mechanism of the embodiment.

Referring now to FIG. 2, racket base 3 of racket board 2 is fixed to attaching piece 1*b* by a resilient bendable universal shaft coupling 13. Coupling 13 is bendable in different directions. Attaching piece 1*b* is fixed to a base (not shown) under the racket board 2, and is movable, with coupling 13, upward and downward by movement of handle 11, connecting piece 15, vertical portion 14*d*, of T-shaped member 14, and horizontal portion 14*a*, and also sideways movement of handle 11. This results in a backward and forward movement of the racket base (of FIG. 1) 3, and sideways movement of racket base 3. Racket base 3 is connected also to posts 14*b* and 14*c*, which are connected to horizontal portion 14*a*. Thus, when handle 11 is moved backward and forward, posts 14*b*,14*c* will move up and down together so that racket base 3 will tilt upward and downward against the resilience of attaching piece 1*b* as held by coupling 13. When handle is moved left and right, one of posts 14*c* or 14*b* will move upward while the other moves downward, so that racket base 3 will rock leftward or rightward sideways about coupling 13, which is connected to attaching piece 1*b* so as to be bendable to permit such movement of racket base 3. The handle can be moved suitably leftward, rightward, backward, and forward to various degrees to attain the desired angles in desired directions of the tilt and rock of the racket base 3.

Figure 3:
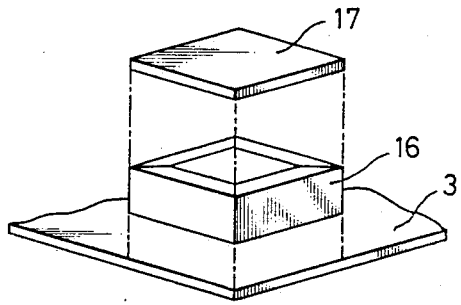
FIG. 3 is a partially cut away perspective view depicting the racket board.
Figure 4:
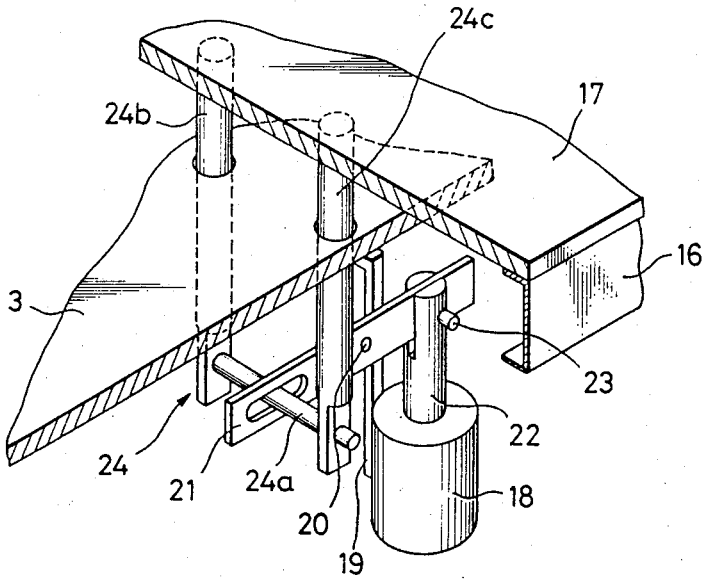
FIG. 4 is a partially cut away perspective view depicting a hitting block operating mechanism of the embodiment.

In FIG. 3, each hitting block 4 comprises a frame 16 and a plate 17. Frame 16 is fixed to plate 17 and is mounted on racket base 3. As depicted in FIG. 4, for each hitting plate 17, a solenoid 18 is attached to the back of racket base 3 via a mounting piece 19 which is connected to a respective operating button 13 on panel 7. The number of solenoids 18 corresponds to the number of hitting blocks 4.

A rocking level 21 supported centrally at a fulcrum 20 is attached at one end thereof to a fore end of rod 22 of solenoid 18 through a shaft 23. The opposite end of rocking lever 21 is loosely fitted to a transverse portion 24*a* of a U-shaped member 24, while vertical portions 24 *b* and 24*c* of U-shaped member 24 extend through racket base 3 and are fixed to plate 17 of each hitting block 4.

When the player pushes any one of operating buttons 12, solenoid 18 connected thereto is energized to pull down rod 22, so that rocking lever 21 pivots about fulcrum 20 and vertical portions 24*b* and 24*c* of U-shaped member 24 push plate 17 of a respective hitting block 4 upward instantaneously. Upon release of the player's finger from operating button 12, the corresponding solenoid 18 is deenergized and rocking lever 21 is forced downward by virtue of the weight of plate 17 on vertical portions 24*b*,24*c* and the weight of U-shaped member 24, so that piston 22 is pulled out from solenoid 18 and plate 17 returns to frame 16. The solenoid may be replaced with a device performing the same functions using air pressure, water pressure, oil pressure, etc.

The operation of the embodiment is as follows. A player first pushes game start button 10 or put a slug or coin into metal inlet port 8 and then one of the balls, stored on the top of box 1, falls into the box. The player operates handle 11 to tilt (i.e. forward and backward, in the desired direction and angle) and rock (i.e. leftward and rightward sideways, in the desired direction and angle) racket board 2 , to catch the ball on the racket board 3. At the same time, the player pushes a particular operating button 12 corresponding to a hitting block 4 at which the ball has fallen or the player expects to fall, thereby to cause block 4 to hit the ball. The ball is thus hit to strike against one of the field plates 1*c* or front plate 1*a*. Then, the ball falls back again onto racket board 3 directly or after rebound. The operation is repeated.

Thus, by operating concurrently or sequentially operating handle 11 and operating button 12, the ball is repeatedly hit back against plate 1*c* or 1*a* to score points , or the player may receive back coins or slugs through metal discharge port 9 according to a predetermined scoring scheme.

If the ball is not hit with a certain force, the ball will roll on racket board 2 and fall into slot 5 formed along the peripheral edges thereof. Or the ball may fall from the plate into the slot. In either case, the game will be over.

The fallen or lost ball received in slot 5 is transferred to transfer device 6 and again stored onto the top of box 1.

Figure 5:
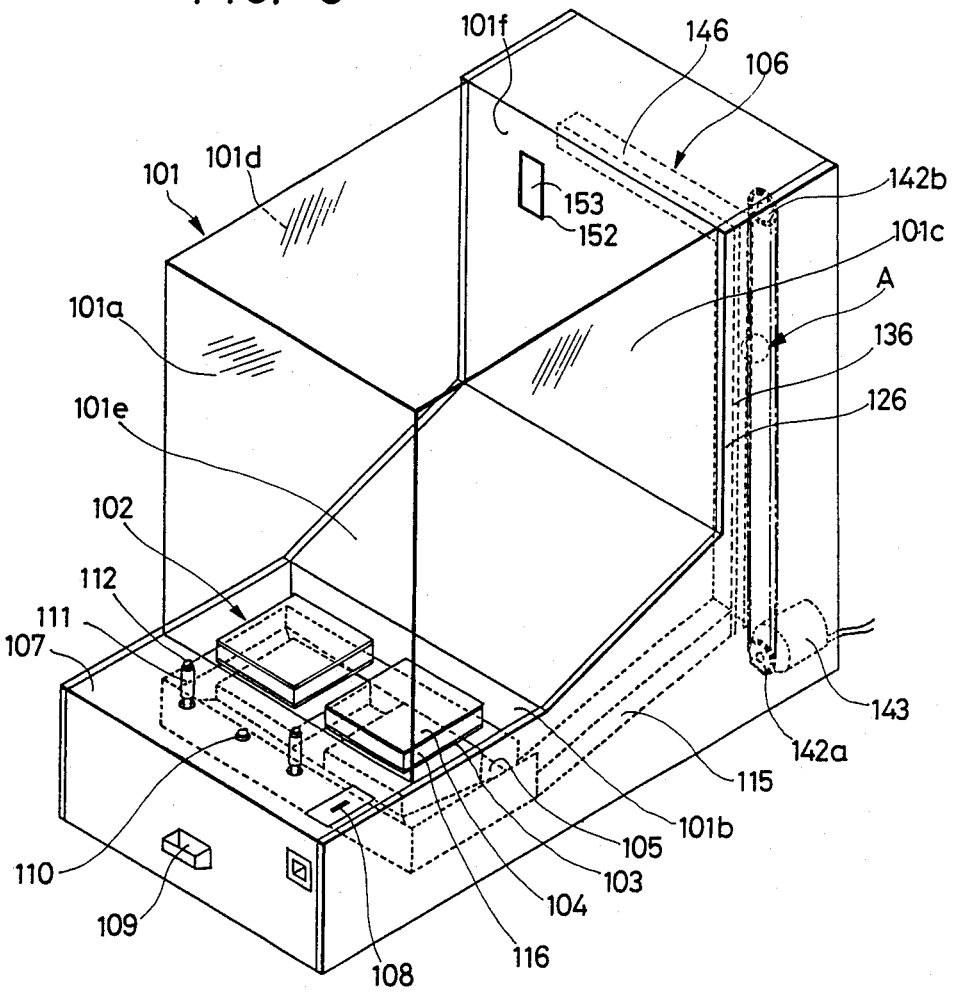
FIG. 5 is a perspective view depicting another illustrative embodiment of the invention.

Referring to FIG. 5, a front ace 101*a*, and both side faces 101*c*, 101*d* of box 101 are formed of transparent material, such as glass or plastic, similar to the embodiment of FIG. 1. An inclined face 101*e* is provided in box 101, together with a back face 101*f*, a ceiling face 101*g* and side wall faces 101*c*, each of which constitutes a play field plate. A racket board 102 is disposed on an inside bottom face 101*b*.

Each of the two racket boards 102 comprises a racket base 103 and a hitting block 104 disposed thereon. A frame member 116 is secured to hitting block 104, both of which are disposed on racket base 103. In FIG. 5, there are shown two racket boards 102, but, more or less can be used.

Between racket board 102 and side wall faces 101*c* of box 101 is formed a slot 105 for catching lost or fallen balls. A transfer device 106 is provided for transferring and storing lost or fallen balls which have fallen into slot 105. The lost or fallen ball is guided through a groove 115, to an upper part of box 101 using a known means, such as, for example, a mechanical chain elevator, electrical or pneumatic elevator mechanism, etc.

Figure 6:
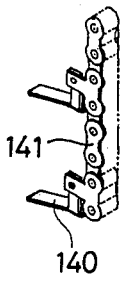
FIG. 6 is an enlarged view showing portion A of FIG. 5.

FIG. 6 shows a portion A of the transfer device 106 comprising an endless chain 141 which provides a plurality of L-shaped supports 140 for carrying a lost or fallen ball between chain wheels 142*a*,142*b*. L-shaped supports 140 are protruded within a vertical guide groove 126 through a slit 136. The ball carried on L-shaped support 140, is transferred upward when chain wheel 142*a* is driven by a motor 143 and is stored within storing groove 146.

There are two operating handles 111, one for each racket board 102, to tilt and rock the respective racket board 102, in the same manner as discussed with reference to the FIG. 1 embodiment.

Figure 9:
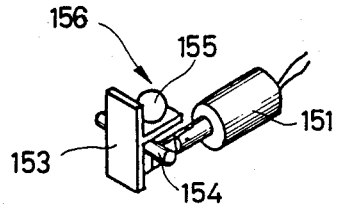
FIG. 9 is a perspective view depicting a ball supplying device.

An operating panel 107 is provided in front of front face 101*a*, on which are provided a metal inlet port 108, a metal discharge port 109, a game start button 110, an operating handle 111 for racket board 102, and an operating button 112 disposed on handle 111 for operating a respective hitting block 104. Ball 155, stored in storing groove 146, is placed on a T-shaped support member 153 (FIG. 9). T-shaped support member 153 is fitted into an-opening 152 of back face 101*f* and is turned about a shaft 154 to cause ball 155 to fall into box 101 when solenoid 151 of ball supplying device 156 (FIG. 9) is actuated by pushing start button 110 or by dropping a coin into slot 108.

Racket board 102 and hitting block 104 have the same construction as those of the embodiment of FIG. 1. When a player pulls operating handle 111 in a desired direction, the racket board 102 is tilted and rocked at a desired angle and in a desired direction while coupling 13 (see FIG. 2) is bent.

Figure 7:
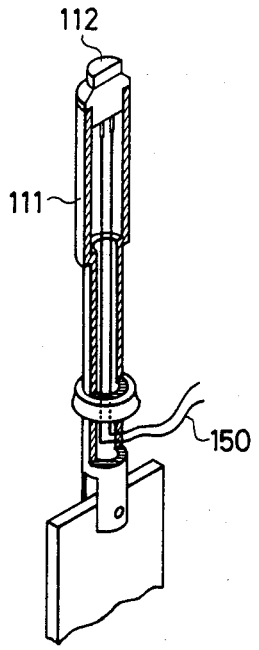
FIG. 7 is a partially cut away front view of an operating handle.
Figure 8:
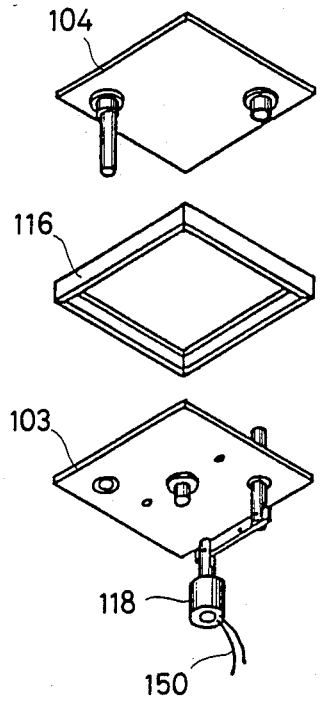
FIG. 8 is a perspective view depicting parts of a racket board.

As shown in FIG. 8, hitting blocks 104, each comprises a frame 116 and a plate 104. Frame 116 is fixed to plate 104 and mounted on racket base 103. Solenoid 118 is attached to the back of racket base 103 and is connected electrically to operating button 112 (FIG. 7) on operating handle 111 by a lead 150. When the player pushes operating button 112 on handle 111, the respective solenoid 118 connected thereto is energized to push hitting block 104 upward instantaneously. Upon release of the player's finger from button 112, solenoid 118 is deenergized and hitting block 104 is forced down by virtue of its own weight.

The following construction may be added to the game machine in order to enhance further amusement value thereof.

The box may be in the form of a prism or a cylinder in place of the shapes shown for the FIG. 1 and FIG. 5 embodiments, whereby unexpectedness can be attained. For example, the ball hit by the hitting block may advance in an unexpected direction after striking against a play field plate. Moreover, it is not necessary that the hitting block or blocks be disposed throughout the entire surface of the racket base. Its shape is not limited to that of a rectangle. For example, it may be circular disk like, or a circular dome having a central protuberance. By adapting such shapes, there can be attained unexpectedness. For example, the ball which was hit back by the hitting block may advance in an unexpected direction.

In the embodiment of FIG. 1, a transparent plate is used for the front face 1*a* of box 1, while the other plates on the sides are used as field plates. However, such other sides and top plates may also be of transparent material so that the player can see inside the box from various angles.

Furthermore, push button switches may be arranged in an appropriate form on the play field plates and given marks so that when the ball is hit by the hitting block and strikes a push button switch, a lamp is turned on or on and off, and if further desired, a sound may be made to advise the player that a score has been made. The score may be displayed additively on a digital indicator, or an appropriate number of slugs corresponding to the score may be discharged from the metal discharge port.

Moreover, the invention may be constructed so that when a ball strikes against a specific push button switch, another ball is thrown into the box additionally, thus permitting play using a plurality of balls at a single time interval. Also, the play field plates may be of the same construction as in an arrange ball game, or in a bingo game to provide a game machine which combines squash ball game with the arrange ball game or bingo game. Further, the play field plate front may comprise an illuminated lattice work using a photo electric cell or tube so that a signal is generated when the ball strikes against a crossing point of beams to thereby result in breaking at that point longitudinal and transverse beams. This causes changes in illumination, image, color, etc, on the play field plate surface, or displays the score obtained. Moreover, a goal ring may be provided in an appropriate position of a play field plate to afford a game machine with basket ball game motif. Also, the game may be based on a volley ball game motif in which two racket boards are provided within the box, a net stretched therebetween with two sets of operating handles on the operating panel used for operating the racket boards, as well as operating buttons, etc. Using this arrangement, two players may operate the racket boards to hit the ball against the other player's play field plate beyond the net to compete against each other. Thus, a more interesting game machine of enhanced amusement can be attained by the addition of various ideas and modifications.

Furthermore, push button switches may be provided on the play field plates so that the switches are pushed when the ball is hit back by the hitting blocks to play for scores. Moreover, there may be adopted the characteristics of the arrange ball game, or the bingo ball game, or the basket ball game, or the volley ball game, etc. Thus, by adding various modifications there is attained a more interesting and amusing game machine.

What is claimed is:

1. A squash ball game machine comprising a play field box provided on outside surfaces thereof with a transfer device and an operating panel, and a racket board connected through a link mechanism to an operating handle provided in the operating panel, the racket board being capable of tilting and rocking in accordance with the operation of the operating handle, the improvement characterized in that said racket board comprises a racket base and at least one hitting block placed thereon, an eject mechanism attached to said racket base, said eject mechanism functioning to cause said at least one hitting block to move upward from the racket base upon depression of an operating button, a lost ball recovering slot formed between the peripheral wall surface of said play field box and the peripheral edge of said racket board, and said transfer device being provided on an outside surface of said play field box to transfer and store a lost ball which had fallen into said slot, onto an upper part of said play field box.

2. The game machine of claim 1, comprising a plurality of said hitting blocks.

3. The game machine of claim 1, wherein said operating button is provided on said operating panel.

4. The game machine of claim 1, wherein said operating button is provided on said operating handle.

* * * * *